United States Patent [19]

Waniczek et al.

[11] Patent Number: 4,465,028

[45] Date of Patent: Aug. 14, 1984

[54] IGNITION IMPROVERS FOR INTERNAL COMBUSTION ENGINES

[75] Inventors: Helmut Waniczek, Cologne; Herbert Bartl, Odenthal; Klaus Krüger, Bergisch-Gladbach, all of Fed. Rep. of Germany

[73] Assignee: Bayer Aktiengesellschaft, Leverkusen, Fed. Rep. of Germany

[21] Appl. No.: 396,516

[22] Filed: Jul. 8, 1982

[30] Foreign Application Priority Data

Jul. 24, 1981 [DE] Fed. Rep. of Germany ..... 3129271

[51] Int. Cl.[3] ..... F02B 75/12

[52] U.S. Cl. ..... 123/1 A; 44/53; 44/57; 123/198 A

[58] Field of Search ..... 44/53, 57, 77; 536/115, 536/17.7; 123/1 A, 198 A

[56] References Cited

U.S. PATENT DOCUMENTS

| | | | |
|---|---|---|---|
| 1,995,911 | 3/1935 | Wysocki et al. | 44/7 |
| 2,001,070 | 5/1935 | Shankweiler et al. | 44/7 |
| 2,046,101 | 6/1936 | York | 44/7 |
| 4,123,997 | 11/1978 | Oswald et al. | 123/1 |

FOREIGN PATENT DOCUMENTS

| | | |
|---|---|---|
| 164635 | 10/1903 | Fed. Rep. of Germany . |
| 719708 | 2/1930 | France . |

*Primary Examiner*—Mrs. Y. Harris-Smith

*Attorney, Agent, or Firm*—Sprung, Horn, Kramer & Woods

[57] ABSTRACT

Nitric acid esters of monosaccharides and/or polysaccharides can be used as ignition improvers for alcoholic fuels for internal combustion engines.

26 Claims, 8 Drawing Figures

IGNITION IMPROVERS FOR INTERNAL COMBUSTION ENGINES

The invention relates to ignition improvers in alcoholic fuels for engines which function according to the principle of self-igniting internal combustion engines.

Instead of the customary petroleum products, methanol and ethanol can be used as fuels for Otto engines. However, this is not possible in the case of diesel engines of a customary design since the cetane numbers of ethanol at about 8 and of methanol at about 3 are too low. Diesel engines require for trouble-free working a fuel having a cetane number of at least 45 (DIN 51,601; Winnacker-Küchler, Chemische Technologie (Chemical Technology), Volume 3/I, 326 (1971)).

It is necessary to make use of ignition improvers to raise the cetane number. Alkyl nitrates and cycloalkyl nitrates are known as ignition improvers for fuels from methanol or ethanol (German Offenlegungsschrift No. 2,701,588, German Offenlegungsschrift No. 2,039,609 and Mineralöl Technik 80, 25 (4), 1 to 12), but they are expensive to manufacture and they hydrolyze in the presence of water. This produces nitric acid which destroys engines by corrosion.

Nitric acid salts of primary, secondary and tertiary amines, such as monoethylammonium nitrate, diethylammonium nitrate or triethylammonium nitrate, are also known as ignition improvers for methanol and ethanol (German Offenlegungsschrift No. 2,909,565). they likewise have corrosive properties.

New ignition improvers for alcoholic fuels for internal combustion engines have been found which contain nitric acid esters of monosaccharides and/or polysaccharides.

Ignition improvers according to the invention are highly suitable for use as additives in alcoholic fuels. Fuels thus treated are equivalent or superior to commercially available fuels based on mineral oil.

In combination with ignition improvers according to the invention, fuels based on alcohols are particularly suitable for the operation of diesel engines. This is possible since the ignition performance of alcoholic fuels can be raised to the level of commercially available diesel fuels (cetane number at least 45) with the aid of ignition improvers according to the invention.

Nitric acid esters of monosaccharides and/or polysaccharides are in themselves known (K. Fabel, Nitrocellulose-Herstellung und Eigenschaften [Nitrocellulose-Preparation and Properties], Enke-Verlag, Stuttgart (1950)).

Alcoholic solutions of nitric acid esters of polysaccharides are disclosed in U.S. Pat. No. 1,995,911, U.S. Pat. No. 2,001,070 and U.S. Pat. No. 2,046,101.

Pentoses and hexoses are preferred monosaccharides for use as starting materials for nitric acid esters according to the invention. The following monosaccharides may be mentioned as examples: ribose, glucose, mannose and galactose.

Polysaccharides for nitric acid esters according to the invention are all linear, branched or cyclic polymers formed from monosaccharide basic building blocks. Disaccharides or oligosaccharides which produce at least two monosaccharide building blocks on hydrolysis are also polysaccharides for nitric acid esters according to the invention. The following polysaccharides may be mentioned as examples: sucrose, lactose, maltose, raffinose, cellulose, hemicellulose and starches, such as, amylose, amylopectin and dextrin.

It is of course also possible to use hydrolytically or oxidatively obtained degradation products of polysaccharides for nitric acid esters according to the invention. Such degradation products are in themselves known (Houben-Weyl, Volume XIV/2, pages 866 to 868 (1963)). Degradation products of polysaccharides are preferred saccharides for the nitric acid esters according to the invention. Such degradation reactions can also be carried out in a manner which is in itself known on the finished nitric acid esters of polysaccharides, for example by means of boiling under pressure (Winnacker-Küchler, Chemische Technologie [Chemical Technology], Volume 4/II, 737 to 738 (1960)).

Nitric acid esters of monosaccharides and polysaccharides can be prepared by known processes (Houben-Weyl, Volume VI/2, 356 (1963) and Volume XIV/2, 868–871 and 603 (1969)).

The preparation can be carried out, for example, in a homogeneous and/or heterogeneous phase by means of nitric acid or its anhydride in the presence of dehydrating agents, such as sulphuric acid, phosphoric acid, phosphorus pentoxide or acetic anhydride. The degree of nitration can be controlled as desired by the amount and concentration of the nitric acid or of the dehydrating additives.

The degree of nitration affects not only the solubility in alcohol but also the effectiveness of the ignition improvers claimed. Nitric acid esters of monosaccharides and polysaccharides, according to the invention, preferably have a degree of nitration of at least one nitro group per monosaccharide unit. The complete esterification of all hydroxyl groups of the corresponding carbohydrates is to be considered as the upper limit of the degree of nitration. However, in these cases the solubility of the nitric acid esters in alcohol is lowered.

Nitric acid esters of monosaccharides and/or polysaccharides used as ignition improvers advantageously have a degree of nitration of 1 to 3, preferably of 1.5 to 2.7, and particularly preferably of 2 to 2.5.

To improve the solubility in alcohol other substituents, in addition to the nitro group, can also be bonded to the saccharides, such as, for example, methoxyl, ethoxyl, carboxymethyl, hydroxyethyl, long-chain fatty acid radicals, nitrite groups or sulphuric acid ester groups.

Alcoholic fuels to which the ignition improvers according to the invention are added are in general alcohols having 1 to 4 carbon atoms. Examples which may be mentioned are methanol, ethanol, propanol, butanol and isomers thereof. It is of course also possible to use mixtures of these alcohols. The alcoholic fuels can also contain higher alcohols.

The alcoholic fuels contain in general 0.1 to 15% by weight, preferably 2 to 10% by weight, of the ignition improvers according to the invention.

In order to increase the solubility of the ignition improvers according to the invention in alcoholic fuels one can add solubilizers. Examples of these which may be mentioned are low-molecular ketones and esters, such as acetone, methyl ethyl ketone, diethyl ketone, methyl acetate, ethyl acetate and butyl acetate, and ethers, such as diethyl ether, diisopropyl ether, dibutyl ether, tetrahydrofuran, furfurol, dioxane, ethylene glycol monoethyl ether, ethylene glycol diethyl ether, triethylene glycol monoethyl ether and triethylene glycol diethyl ether.

The fuel mixtures claimed can also contain small amounts of water, in general up to 20%. A water content in fuel mixtures according to the invention of 0.5 to 6% is particularly preferred.

Fuel mixtures according to the invention have proved particularly suitable in the operation of conventional diesel engines and they are distinguished by a high reliability, the absence of ignition failures and outstanding operating characteristics, in particular under the conditions of continuous operation. Among ignition improvers according to the invention those nitric acid esters of monosaccharides and/or polysaccharides are preferably used which have an adequate stability at room temperature. This is the case above all for nitric acid esters of polysaccharides which have been stabilized, for example by pressure boiling (Houben-Weyl, Volume XIV/2, page 870 (1963)) or by the addition of suitable stabilizers. Such stabilizers are known. Nitrocellulose is thus stabilized in U.S. Pat. No. 2,404,887 by mixing with a dilute, aqueous ammonia solution. H. Brunswig describes a series of other stabilizers, such as ethyl acetate, amyl acetate, acetone, aniline, diphenylamine or diethyldiphenylurea in "Die Explosivstoffe (Explosive Substances) VIII", "Das rauchlose Pulver (Smokeless Powder)" on pages 368 to 378 (1926).

Nitric acid esters of monosaccharides and/or disaccharides can be stabilized in the same way as the nitric acid esters of polysaccharides are stabilized, if the stability thereof is not ensured by an adequate purification, such as recrystallization.

Fuel mixtures according to the invention also have the advantage that they do not destroy the engine by corrosion. They are readily produced industrially and can be used without any further safety precautions.

EXAMPLES

The action of ignition performance improvers and the engine characteristics of alcoholic fuel mixtures according to the invention were determined on a test engine. The engine used was an air-cooled 1-cylinder 4-stroke diesel engine having a displacement of $V_d = 1.6\ dm^3$ and a compression ratio of $\epsilon = 18.2$ at an operating pressure of 7 bars effective mean pressure and a mean engine speed of $n = 1{,}600\ min^{-1}$.

This operating pressure and an engine tuning corresponding to standard operation and also corresponding component and oil temperatures produce self-ignition conditions which are customary, and hence representative, in standard direct-injection engines in full-load operation.

The injection starts at about 164° crank angle and the injection period E is about 22° crank angle.

The ignition performance of fuel mixtures according to the invention was assessed by comparison against the cylinder pressure pattern, the ignition lag and the combustion behaviour when using a commercially available diesel fuel DF in accordance with DIN 51,601 and on using a mixture of 20% cetane (hexadecane) and 80% of $\alpha$-methylnaphthalene, which is referred to in the text below as standard fuel SF.

On using SF which has a cetane number of 20 the one-cylinder diesel engine used has, under conditions of full-load operation and correspondingly good ignition conditions, a still adequate ignition reliability with the start of combustion, characterized by the first marked increase of $dx/d\alpha$, approximately at the upper dead-centre of the expansion stroke. The difference between the start of combustion and the start of injection is called ignition lag and is indicated in degree crank angle. % data below are to be understood as % by weight.

EXAMPLE 1

(a) Preparation of an ignition improver

Bleached cotton linters are treated in a manner which is in itself known at 20° C. while stirring with the 50-fold amount of a nitrating acid consisting of 79.6% of sulphuric acid, 11.4% of nitric acid and 9.0% of water. After a 2 hour nitrating period the cellulose nitrate formed is separated off from the acid and washed with distilled water until neutral, and the product is boiled for 3 hours in the 20-fold amount of a 3% strength aqueous $NaHCO_3$ solution for the purpose of stabilizing it. The cellulose nitrate is again separated off from the liquid, washed with water until neutral, and the fibrous product is dried in vacuo at 30° C.

An elemental analysis of this cellulose nitrate has a result of 24.7% of carbon, 3.0% of hydrogen and 11.2% of nitrogen.

(b) Formulation of a fuel mixture

4% and 8% solutions of the cellulose nitrate described in (a) are prepared in an azeotropic mixture of 96% of ethanol and 4% of water. The two solutions are filtered through a pressure filter in order to remove volatile substances.

(c) Engine test

The test engine described is operated with the fuel solutions according to the invention described in (b). For comparison, test runs are carried out with standard fuel SF (cetane number 20) and with diesel fuel DF (cetane number 55).

Figure 1:
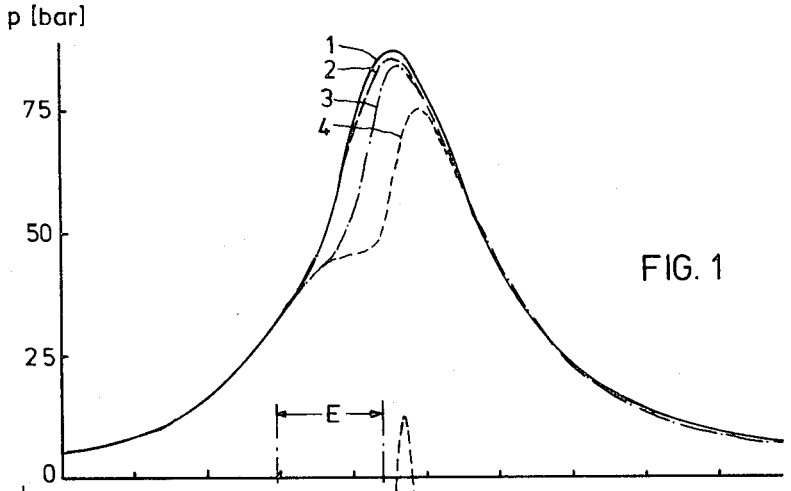
FIGS. 1, 3, 5 and 7 show, by way of example, the cylinder pressure p [bar] as a function of the respective position of the piston which is given in terms of $\alpha$=degree crank angle (in the text below also abbreviated to °CA). A crank angle of 180° corresponds to the upper dead-centre position of the piston.
Figure 2:
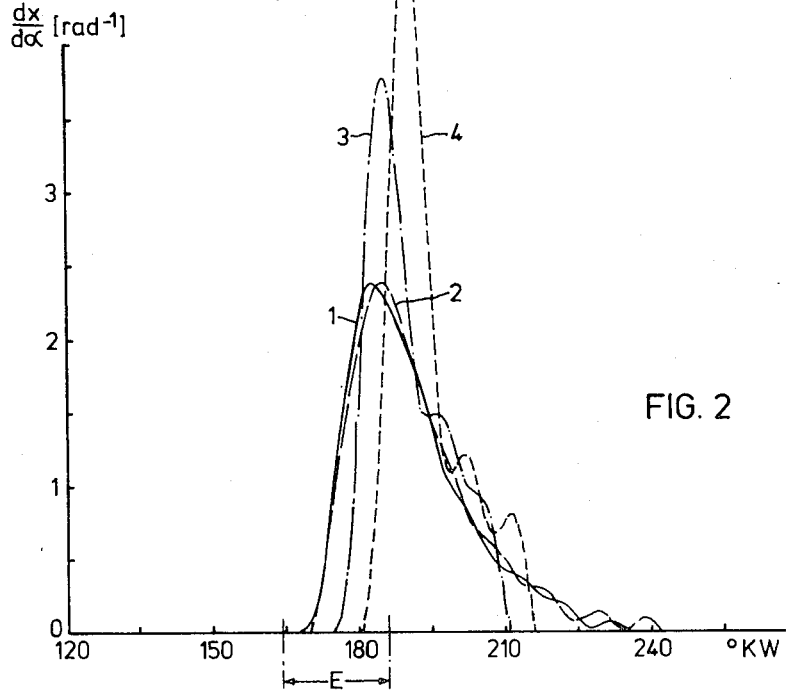
FIGS. 2, 4, 6 and 8 show, by way of example, the standardized fuel conversion $dx/d\alpha$ [$rad^{-1}$] as a function of $\alpha$=degree crank angle [°CA].

FIGS. 1 and 2 show the engine characteristics of DF (curve 1), SF (curve 4), the ethanolic solution containing 4% (curve 3) and the ethanolic solution containing 8% of the cellulose nitrate in accordance with Example 1a (curve 2).

PRESSURE PATTERN (FIG. 1)

On using DF the pressure increases steeply after the start of the injection and starts to drop again at about 190° CA. The pressure patterns on operating the engine with ethanol and 8% of the cellulose nitrate are virtually identical. On operating with standard fuel the pressure increase only takes place considerably later, whilst already 4% of the cellulose nitrate in accordance with 1a in ethanol provides a considerable improvement.

FUEL CONVERSION (FIG. 2)

The ignition lag of the 8% strength ethanolic cellulose nitrate solution is virtually as low as that for diesel fuel. The 5% strength cellulose nitrate solution has a considerably shorter ignition lag than the standard fuel despite the fact that pure ethanol has a cetane number of only 8.

The combustion behavior of ethanol is made virtually identical to that of DF by means of an 8% strength addition of cellulose nitrate and already a 4% strength addition of cellulose nitrate produces a considerable improvement compared to the standard fuel.

EXAMPLE 2

(a) Preparation of an ignition improver

A cellulose nitrate is prepared as in Example (1a).

(b) Formulation of a fuel mixture

A 4% strength by weight and an 8% strength by weight solution in technical grade methanol is prepared from the cellulose nitrate described in (a) and the solutions are filtered through a pressure filter.

(c) Engine test

Figure 3:
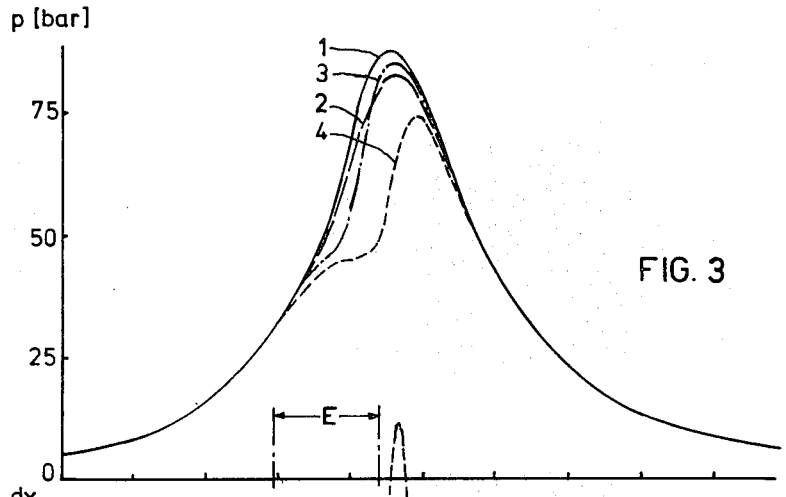
Figure 4:
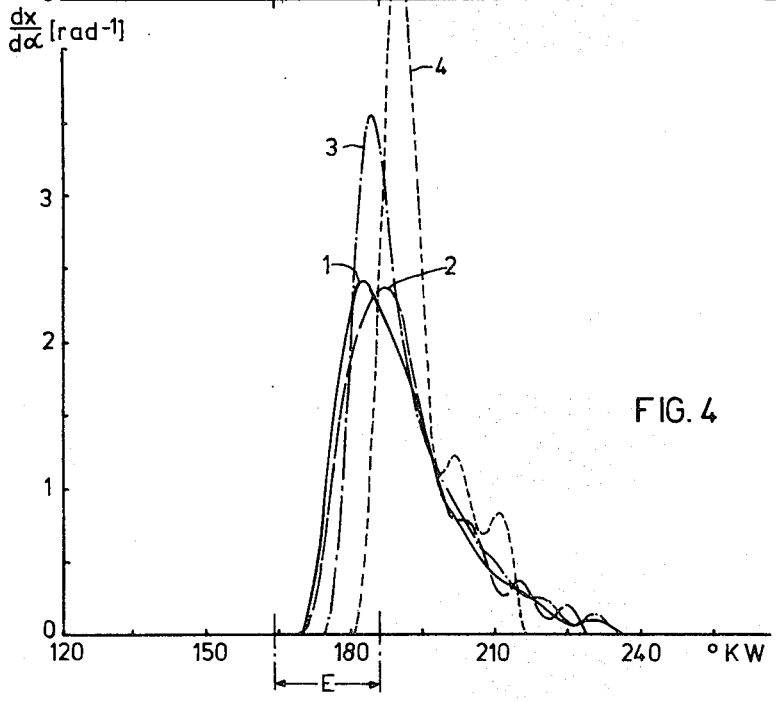

The test engine is operated as in Example (1) with the methanolic solutions of the cellulose nitrate and the characteristic values are compared with diesel fuel DF and standard fuel SF. FIG. 3 describes the pressure pattern and FIG. 4 describes the fuel conversion on using DF (curve 1), SF (curve 4), a 4% strength (curve 3) and an 8% strength (curve 2) methanolic cellulose nitrate solution.

Although the ignition performance of methanol (cetane number=3) is still worse than that of ethanol (cetane number=8), the 8% strength solution achieves the same ignition lag as diesel fuel. Already 4% by weight of cellulose nitrate in methanol produce a considerable improvement of the ignition performance, as is evident from the short ignition lag of only 11° CA.

EXAMPLE 3

(a) Preparation of an ignition improver 200 g of a commercially available nitrocellulose having a K value by the Fiken'scher method (Cellulosechemie 13. [1932] 58) of K=730 and a nitrogen content of 11.2% are distributed in 2 l of water and the mixture is heated with stirring to 90° C. after the addition of 5 ml of pyridine. After 15 hours at 90° C., the collodion cotton wool which is now yellowish is filtered off with suction and boiled for 1 hour in 2 l of a 2% strength aqueous formaldehyde solution. Thereafter the product is again filtered off with suction and washed with water until neutral, and the fine, fibrous product is dried at room temperature to a residual moisture content of 10%.

(b) Formulation of a fuel mixture 4.4 parts of the moist nitrocellulose are dissolved in 92.2 parts of ethanol and 3.4 parts of water. A 4% strength solution of the ignition improver in the ethanol/water azeotrope is obtained.

(c) Engine test

Figure 5:
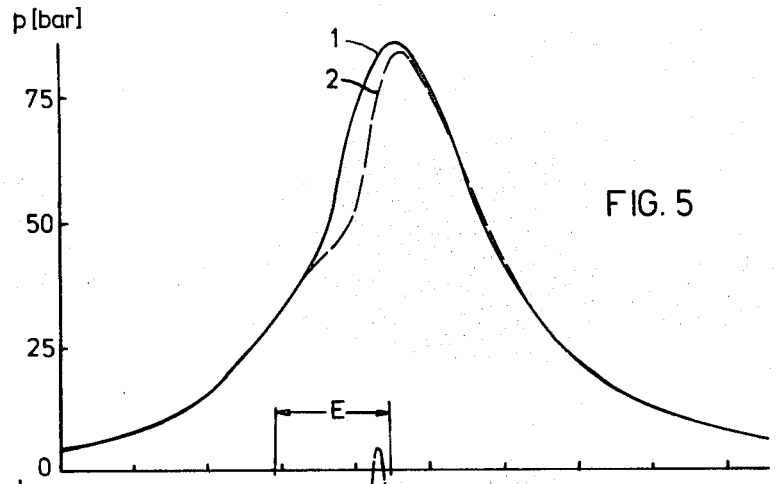

The test engine is operated with the ethanolic solution of this ignition improver and the combustion behaviour compared to that of DF is determined. FIG. 5 shows the pressure pattern of DF (curve 1) and of the test solution (curve 2).

Figure 6:
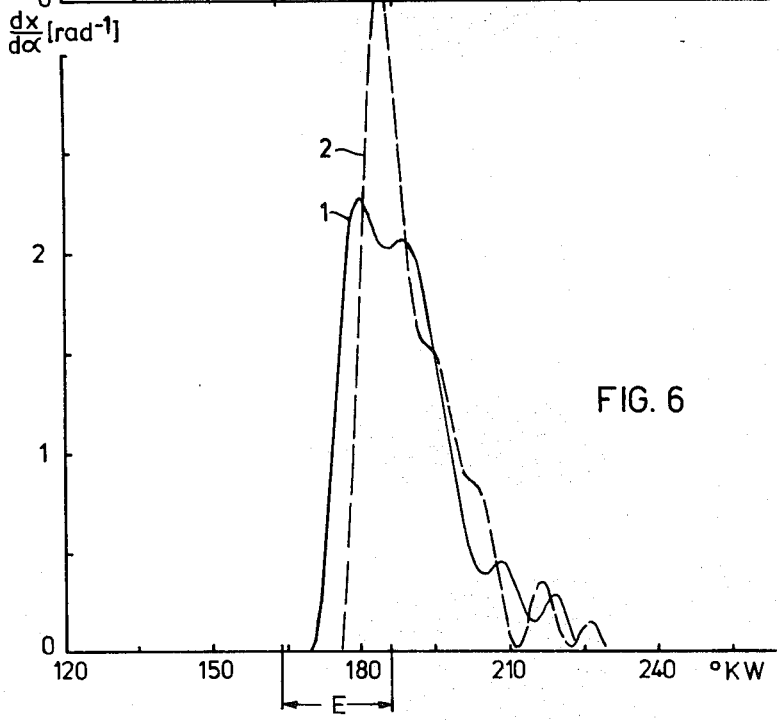

FIG. 6 indicates the fuel conversion for DF (curve 1) and for the test solution (curve 2). Although the ignition lag of the test solution is somewhat larger than that of DF, the pressure pattern is very similar.

EXAMPLE 4

(a) Preparation of an ignition improver

Arabinose tetranitrate is prepared by adding 10 g of arabinose to 100 $cm^3$ of nitric acid (98% strength) at 0° C. 300 $cm^3$ of sulphuric acid (98% strength) is added dropwise to this solution while cooling so that the temperature does not exceed 2° C.

The reaction mixture is then poured onto 2,000 g of ice and a pulverulent solid substance precipitates. This is filtered off, washed with water and dissolved in 50 ml of absolute ethanol at 50° C. After this solution has been cooled down to −10° C., colourless crystals precipitate which are filtered off with suction and dried in vacuo at 20° C.

(b) Formulation of a fuel mixture

A 4% by weight and an 8% by weight solution of the arabinose tetranitrate in the azeotrope ethanol/water (96:4) is prepared with slight heating.

(c) Engine test

The test engine is operated for comparison with DF, SF and the two test solutions.

Figure 7:
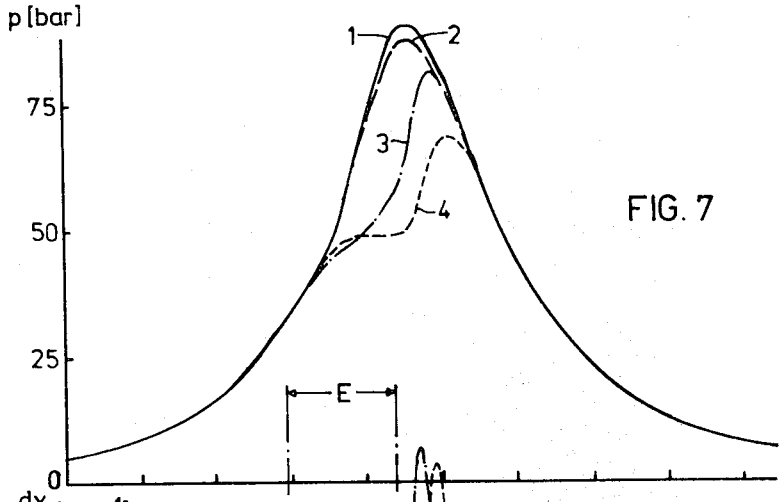

FIG. 7 describes the cylinder pressure pattern when using DF (curve 1), SF (curve 4), the 4% strength ethanolic solution of arabinose tetranitrate (curve 3) and the 8% strength ethanolic solution of arabinose tetranitrate (curve 2). Already a 4% addition of arabinose tetranitrate to ethanol produces an ignitable fuel mixture, whilst the 8% strength solution produces almost the same pressure pattern as for diesel fuel.

Figure 8:
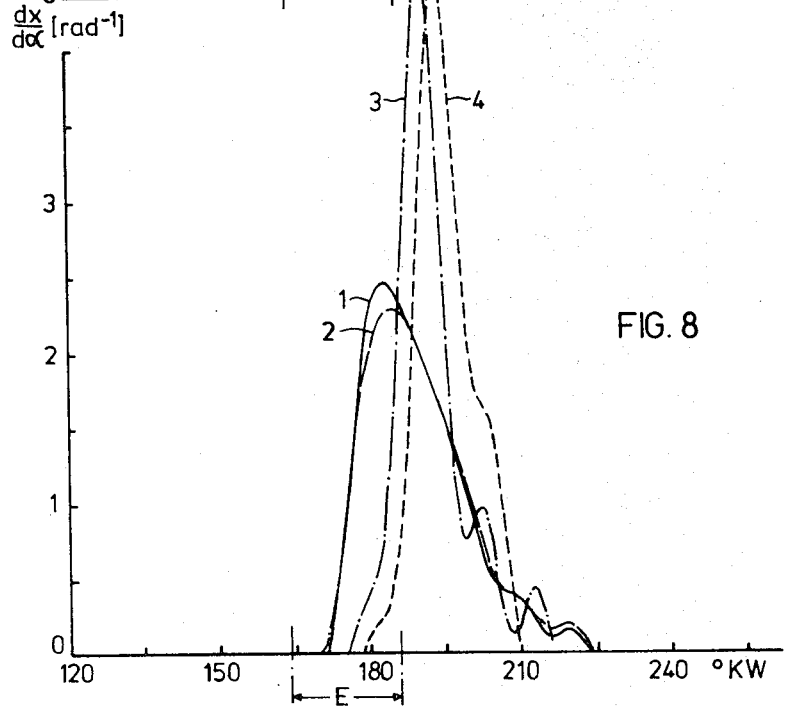

FIG. 8 shows the fuel conversion which in the case of the 8% strength alcoholic solution (curve 2) rises similarly steeply as for DF (curve 1). Already for a 4% strength solution of arabinose tetranitrate in ethanol (curve 3) a more rapid fuel conversion is obtained than for SF (curve 4).

The ignition lag is in the case of (curve 3) almost as short as for DF (curve 1).

What is claimed is:

1. In a diesel engine comprising a combustion zone, said combustion zone being in fluid communication with a fuel reservoir, said fuel reservoir containing a fuel for said diesel engine the improvement wherein said fuel contains a nitric acid ester of a mono or poly saccharide, as ignition improver.

2. A diesel engine according to claim 1, wherein said fuel additionally contains an alcohol.

3. A diesel engine according to claim 2, wherein said nitric acid ester has a degree of nitration larger than 1.

4. A diesel engine according to claim 3, wherein degree of nitration is in the range of 1 to 3.

5. A diesel engine according to claim 2, wherein said fuel additionally contains water.

6. A diesel engine according to claim 5, wherein said water is present in an amount of up to 20% by weight.

7. A diesel engine according to claim 2, wherein said nitric acid ester is present in an amount of 0.1 to 15% by weight.

8. A diesel engine according to claim 2, wherein said alcohol is one having 1 to 4 carbon atoms.

9. A diesel engine according to claim 8, wherein said alcohol is selected from the group consisting of methanol, ethanol, propanol, butanol, isomers thereof and mixtures thereof.

10. A diesel engine according to claim 8, wherein said fuel additionally contains a low molecular ketone, ester or ether.

11. In a process for running a diesel engine wherein a fuel is passed to a combustion chamber of said diesel engine, compressed therein and ignited, the improvement wherein said fuel contains a nitric acid ester of a mono or poly saccharide as ignition improver.

12. A process according to claim 11, wherein said fuel additionally contains an alcohol.

13. A process according to claim 12, wherein said nitric acid ester has a degree of nitration larger than 1.

14. A process according to claim 13, wherein degree of nitration is in the range of 1 to 3.

15. A process according to claim 13, wherein said nitric acid ester is present in an amount of 0.1 to 15 percent by weight.

16. A process according to claim 13, wherein said fuel has a cetane number of at least 20.

17. A process according to claim 13, wherein said fuel has a cetane number of at least 40.

18. A process according to claim 17, wherein said mono or polysaccharide is selected from the group consisting of ribose, glucose, mannose, galactose, raffinose, cellulose, hemicellulose, amylose, amylopectin and dextrin.

19. A diesel engine according to claim 1 wherein said nitric acid ester of mono or polysaccharide is dissolved in said fuel.

20. A diesel engine according to claim 19 wherein said fuel consists essentially of alcohol, said nitric acid ester and, optionally water, the latter in an amount up to 20% by weight.

21. A diesel engine according to claim 19 wherein said fuel additionally contains at least one solubilizer selected from the group consisting of acetone, methyl ethyl ketone, diethyl ketone, methyl acetate, ethyl acetate, butyl acetate, diethyl ether, diisopropyl ether dibutyl ether, tetrahydrofuran, furfurol, dioxane, ethylene glycol monoethyl ether, ethylene glycol diethyl ether, triethylene glycol monoethyl ether and triethylene glycol diethyl ether.

22. A process according to claim 11 wherein said nitric acid ester of mono or polysaccharide is soluble in said fuel.

23. A diesel engine according to claim 19 wherein the degree of nitration of said nitric acid ester is at least 1.5.

24. A process according to claim 22 wherein the degree of nitration of said nitric acid ester is at least 1.5.

25. In a diesel engine comprising a combustion zone, said combustion zone being in fluid communication with a fuel reservoir, said fuel reservoir containing an alcoholic fuel for said diesel engine, the improvement wherein said alcholic fuel contains a nitric acid ester of a mono or poly saccharide, as ignition improver.

26. In a process for running a diesel engine wherein an alcoholic fuel is passed to a combustion chamber of said diesel engine, compressed therein and ignited, the improvement wherein said alcoholic fuel contains a nitric acid ester of a mono or poly saccharide as ignition improver.

* * * * *